US006079307A

United States Patent [19]

Mori

[11] Patent Number: 6,079,307

[45] Date of Patent: Jun. 27, 2000

[54] PAPER CUTTER

[75] Inventor: Makoto Mori, Tokyo, Japan

[73] Assignee: Carl Manufacturing Co., Ltd., Tokyo, Japan

[21] Appl. No.: 09/176,204

[22] Filed: Oct. 21, 1998

[30] Foreign Application Priority Data

May 29, 1998 [JP] Japan ..... 10-166204

[51] Int. Cl.[7] ..... B26D 7/24

[52] U.S. Cl. ..... 83/564; 83/485; 83/582; 83/614; 83/698.41; 83/DIG. 1

[58] Field of Search ..... 83/564, 582, DIG. 1, 83/485, 487, 454, 455, 614, 698.41, 481, 399

[56] References Cited

U.S. PATENT DOCUMENTS

| | | | |
|---|---|---|---|
| 909,227 | 1/1909 | Ridgely | 83/485 |
| 3,237,497 | 3/1966 | Cook | 83/455 X |
| 3,301,117 | 1/1967 | Spaulding | 83/455 |
| 3,532,018 | 10/1970 | Szabo | 83/485 X |
| 5,069,097 | 12/1991 | Mori | 83/455 X |
| 5,103,710 | 4/1992 | Ross | 83/485 |
| 5,303,626 | 4/1994 | Uehara et al. | 83/485 |
| 5,322,001 | 6/1994 | Boda | 83/485 |
| 5,425,295 | 6/1995 | Peters et al. | 83/614 X |
| 5,524,515 | 6/1996 | Boda | 83/564 X |
| 5,671,647 | 9/1997 | Mori | 83/485 X |
| 5,802,942 | 9/1998 | Cornell et al. | 83/564 X |

FOREIGN PATENT DOCUMENTS

| | | | |
|---|---|---|---|
| 1201720 | 1/1960 | France | 83/485 |

*Primary Examiner*—Maurina Rachuba
*Assistant Examiner*—Charles Goodman
*Attorney, Agent, or Firm*—Oliff & Berridge, PLC

[57] ABSTRACT

A paper cutter having a paper stand, a pair of arms of identical length attached to the paper stand defining a contacting position and a separating position, a guide rail connected to the pair of arms such that the guide rail is parallel to the paper stand, a slider slidably attached to the guide rail. The slider has a rotary blade fixed on a holder, the blade being capable of being moved up and down within the slider against a spring, the blade exposed by being pushed down when the slider is in the contacting position, and a stopper, with a top end and a heavy end, which rotates automatically on a shaft due to its heavy end, hooking the top end on a projection provided on the slider to prevent the rotary blade from being projected from the slider when the guide rail is rotated to the other than the contacting position.

2 Claims, 6 Drawing Sheets

1
2
3
4
5
6
9
10
11
12
13
14
15
16
17
18
19
20
21
22
22a
22b
23
24
25
25a
25b
25d

FIG.4(a)
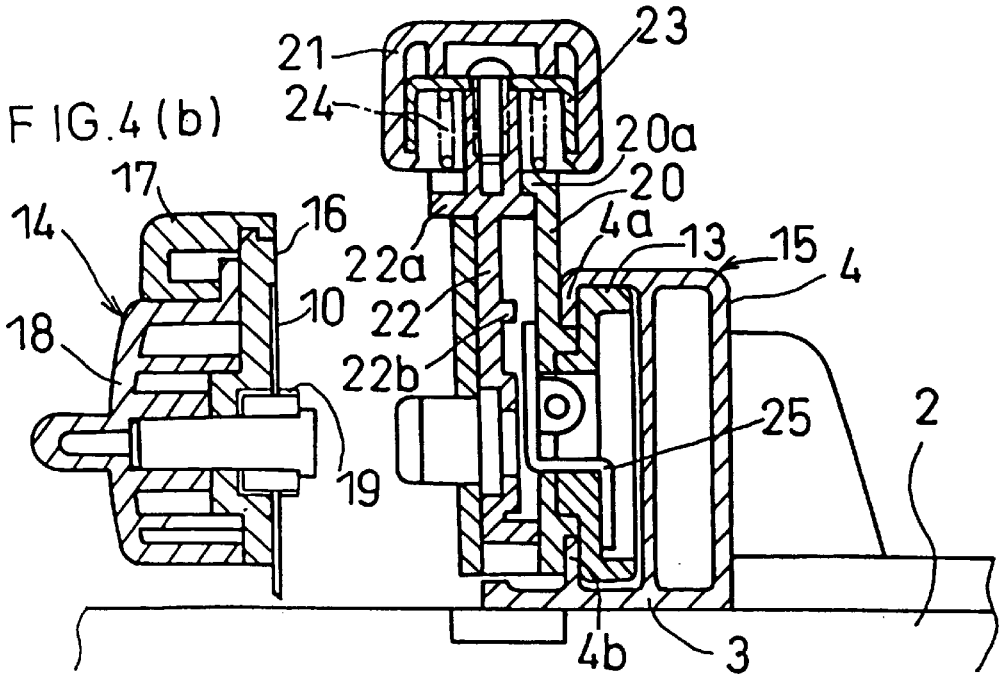
FIG.4(b)
FIG.5(a)
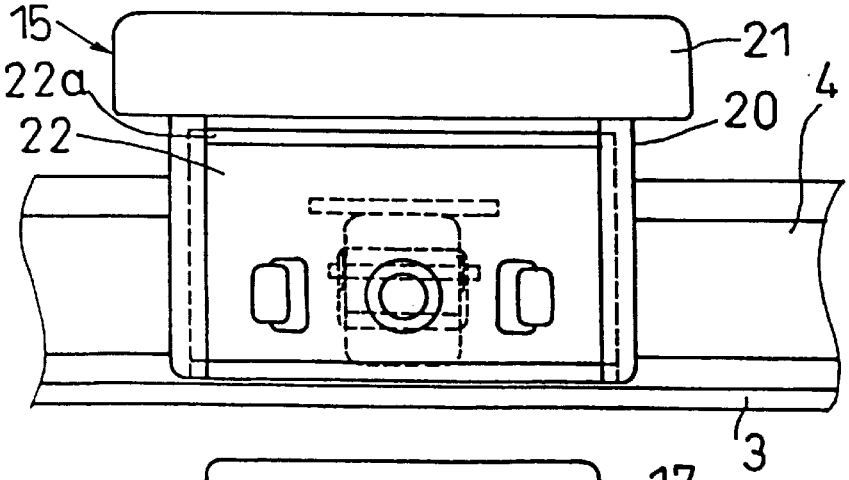
FIG.5(b)
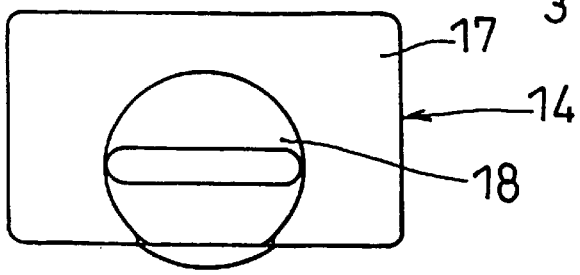

PAPER CUTTER

BACKGROUND OF THE INVENTION

Field of the Invention

In order to cut papers into the same size, it is necessary to use a paper cutting stand for holding the paper in a desired position, a guide rail for guiding a cutter along the paper, and a blade as a cutter moving along the guide rail. In a device for cutting the paper, given the case where the guide rail is rotated about an axis in parallel with its longitudinal direction, when being slanted, the blade is also slanted and exposed outwardly. Accordingly, handling it is dangerous.

The present invention relates to improving the safety of a paper cutter in which, the cutter is attached to the above structured guide rail.

In a paper cutter 1 shown in FIG. 10, a guide rail 4 juxtaposed with a paper holding plate 3 is provided at an end portion of a paper stand 2 for cutting papers along the guide rail 4. Both ends of the guide rail 4 are fixed to one end each of two L-shaped arms 5 and the other end of each of two L-shaped arms 5 are rotatably mounted on both sides of the paper stand 2. Reference numeral 6 denotes a rotation shaft.

Also, a scale is indicated on the paper stand 2 for determining a size of paper. A groove 2*a* is formed perpendicularly to the guide rail 4. A paper abutting scale 8 is held in parallel with the guide rail 4 on a guide piece 7 within the groove 2*a*. Also, a slider 9 is movably mounted on the guide rail 4, and a circular blade 10 (see FIG. 11) is mounted on the slider 9. Incidentally, a cutter mat 11 is laid at a position where the blade 10 is brought into contact with the paper stand 2.

When cutting the papers, the papers are inserted into a gap between the guide rail 4 and the paper stand 2 by slightly rotating the guide rail 4. The papers are arranged at a predetermined position on the paper stand 2 by using the paper abutting scale 8. Thus, the guide rail 4 is returned back to the original position, and the paper holding plate 3 is pressed through the slider 9 and the papers are clamped between the paper holding plate 3 and the paper stand 2. Also, when the slider 9 is pressed downwardly against the internal spring force, the blade 10 is projected from a bottom surface of the paper holding plate 3 to make it possible to cut the papers. Then, when the slider 9 is displaced along the guide rail 4, the papers are cut into a predetermined size.

Also, when the paper cutter 1 is not used or is stored, as shown in FIG. 11, the guide rail 4 is rotated to be held in a slanted posture at 90°, by which the slider 9 is prevented from being displaced.

However, in the above-described paper cutter in the above slanted posture, the blade 10 is not projected from the paper holding plate 3 by the spring force within the slider 9. Nevertheless, when the guide rail 4 and the slider 9 are simultaneously gripped or the slider 9 is pressed against the spring force, the blade 10 is projected from the paper holding plate 3 and dangerous, which causes the user to pay attention.

Also, when the guide rail 4 lifted on the paper stand 2 is rotated by chance and dropped, the blade 10 within the slider 9 would be exposed by accident, which might damage the paper.

SUMMARY OF THE INVENTION

An object of the present invention is to provide a paper cutter provided with a safety mechanism which may prevent a blade from being exposed when it is not in use.

In order to attain the above object, according to the first feature of the present invention, a paper cutter comprising a guide rail provided slidably with a slider having a rotary blade, a pair of arms having an identical length to be connected between both ends of the guide rail and the paper stand in order to make the guide rail rotate in parallel with the paper stand between contacting position to and separating position from the paper stand, and when the guide rail contacts the paper stand, the rotary blade which is fixed on a holder to be moved up and down within the slider against a spring by being pushed down is made to project toward the paper stand, a stopper to prevent the rotary blade from being projected from the slider when the guide rail is rotated to separate from the paper stand is provided.

According to the second feature of the present invention, the stopper is formed in such a manner as it, when the guide rail is separated from the paper stand, is rotated like a pendulum on a rotary shaft due to its unbalanced weight on the shaft and a top thereof hooks projection provided on the slider to prevent the blade from being displaced.

According to the third feature of the present invention, the stopper is balanced to position where it avoids from abutting the projection when the guide rail contacts the paper stand.

BRIEF DESCRIPTION OF THE DRAWINGS

In the accompanying drawings:

FIGS. 4(*a*) and 4(*b*) are exploded views showing an operating/sliding portion (a) and a support portion (b) of a slider and the guide rail shown in FIG. 2;

FIGS. 5(*a*) and 5(*b*) are side views showing the operating/sliding portion (a) and the support portion (b) of the slider and the guide rail shown in FIGS. 4(*a*) and 4(*b*);

DESCRIPTION OF THE PREFERRED EMBODIMENTS

An embodiment of the present invention will now be described with reference to the accompanying drawings.

Figure 3:
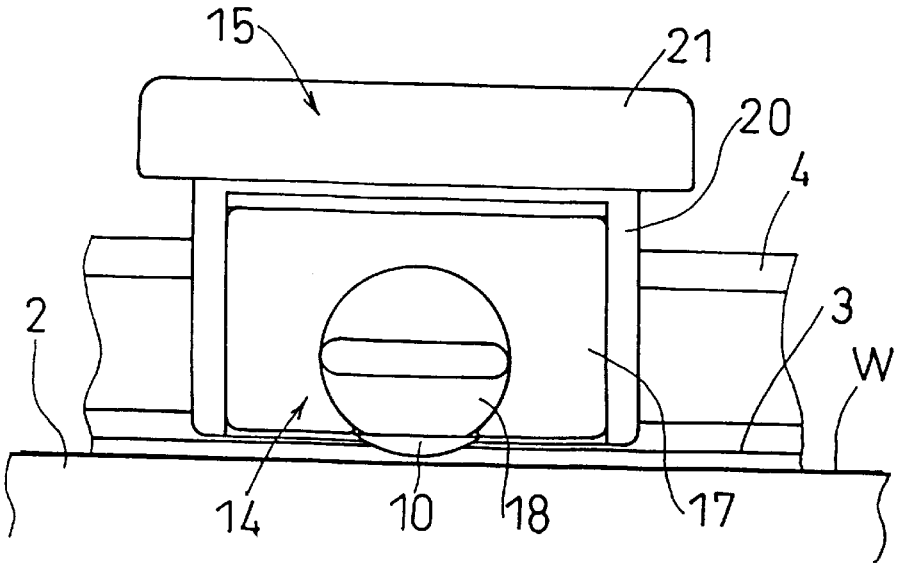
FIG. 3 is a side view showing a main part of the guide rail shown in FIG. 2.

As shown in FIG. 3, in a paper cutter 1, papers W laid on a paper stand 2 is clamped between the paper stand 2 and a paper holding plate 3 juxtaposed below the guide rail 4. A slider 9 is operated along the guide rail 4 to thereby cut the papers W by a rotary blade 10 mounted on the slider 9.

Figure 2:
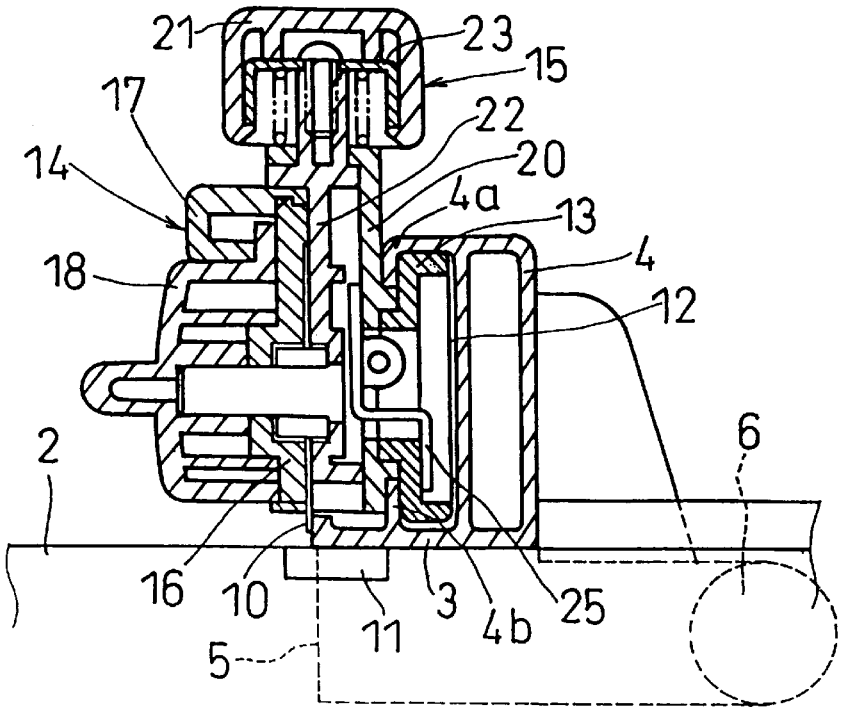
FIG. 2 is a side cross-sectional view showing the slider in a position where the blade can be displaced.

As shown in FIG. 2, a recessed portion 12 provided with claws 4*a* and 4*b* up and down are formed in a longitudinal direction of the guide rail 4 in a side surface of the guide rail 4. A slide block 13 which is engaged with the recessed portion 12 is provided in the slider 9. Also, L-shaped arms 5 having the same length for supporting both ends of the guide rail 4 are pivotally mounted at horizontal end portions thereof on the paper stand 2 by a shaft 6.

As shown in FIGS. 4 and 5, the slider 9 is divided into a support portion 14 of the rotary blade 10 and an operating/sliding portion 15. The support portion 14 is composed of a back plate 16 in intimate contact with a surface of the rotary blade 10, a cutter cover 17 in contact with the back plate 16 from an upper side and a cutter lever 18 in contact with the side of the back plate 16. A rotary shaft 19 is provided on the back plate 16. The rotary blade 10 is rotatably mounted on the back plate 16 so that the rotary blade may be removable.

The operating/sliding portion 15 is composed of the slide block 13, a slide plate 20 fixed to the slide block 13 so as to clamp the upper and lower claws 4*a* and 4*b* of the guide rail 4 for holding the slide block 13, a top cover 21 mounted on an upper portion of the slide plate 20, and a holder (support member) 22 coupled with the support portion 14 and movable up and down together with the support portion 14.

The slide plate 20 is bent at its upper portion to form an upper plate 20*a*. A spring 24 is interposed in a space of a U-shaped plate 23 for covering the upper plate 20*a*. At the same time, the holder 22 which is movable along the slide plate 20 is projected from the upper plate 20*a* and is fastened with the U-shaped plate 23, whereby an eaves portion 22*a* of the holder 22 is in pressing contact with the lower surface of the upper plate 20*a* by a spring force of a spring 24. The top cover 21 is fit around the U-shaped plate 23.

Figure 6:
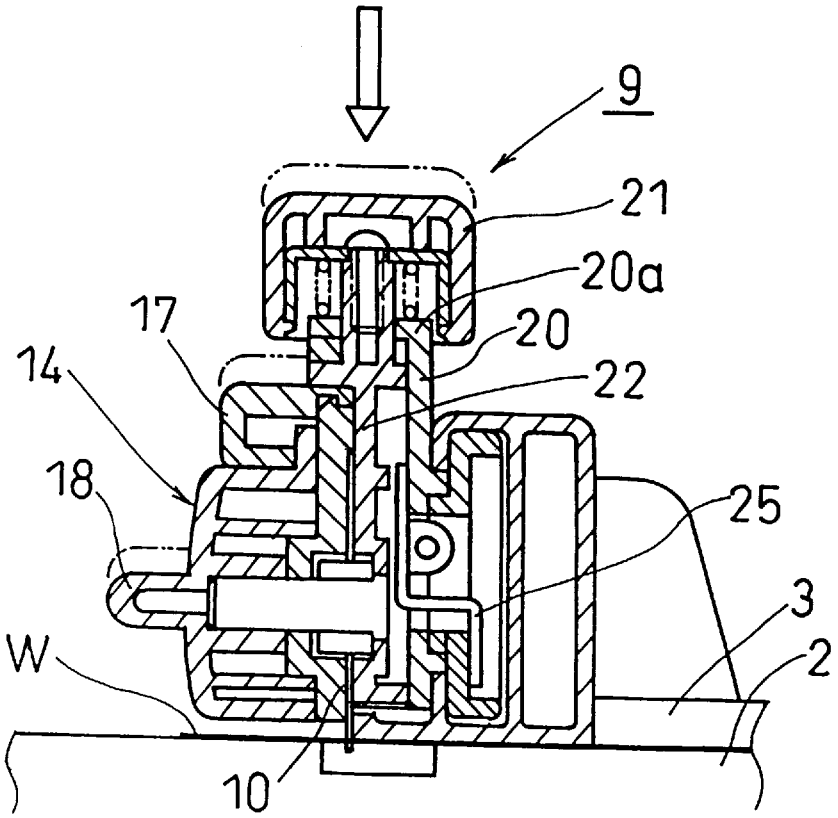
FIG. 6 is a side view showing a pressed condition of the slider and the guide rail shown in FIG. 2.
Figure 7:
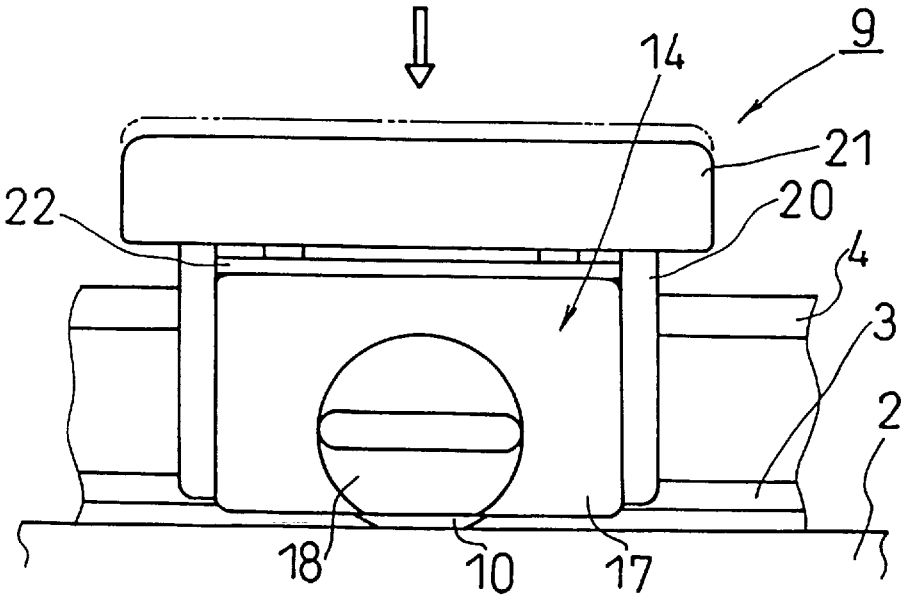
FIG. 7 is a side view showing the slider and the guide rail shown in FIG. 6.

When the top cover 21 is pressed against the spring force of the spring 24, as shown in FIGS. 6 and 7, the upper plate 20*a* of the slide plate 20 is moved downwardly and the holder 22 is lowered. At the same time, the support portion 14 on which the rotary blade 10 is mounted is lowered so that the blade 10 is projected downwardly from the paper holding plate 3. If the papers W are prepared on the paper stand 2, the slider 9 is simply displaced to cut the papers W.

By the way, as shown in FIGS. 4(*a*) and 4(*b*), the joint portion between the slide block 13 and the slide plate 20 is formed into a recessed portion where a stopper 25 is provided as a safety mechanism.

The stopper 25 is pivoted free at an intermediate portion in a longitudinal direction of the guide rail, and, viewing in FIG. 4, the stopper 25 is formed in such a manner as a top end 25*a* of the stopper, by the moment in clockwise direction due to the unbalanced weight of the stopper 25, when the guide rail contacts the paper stand 2, is avoided from being engaged with a projection 22*b* of the holder 22.

Figure 8:
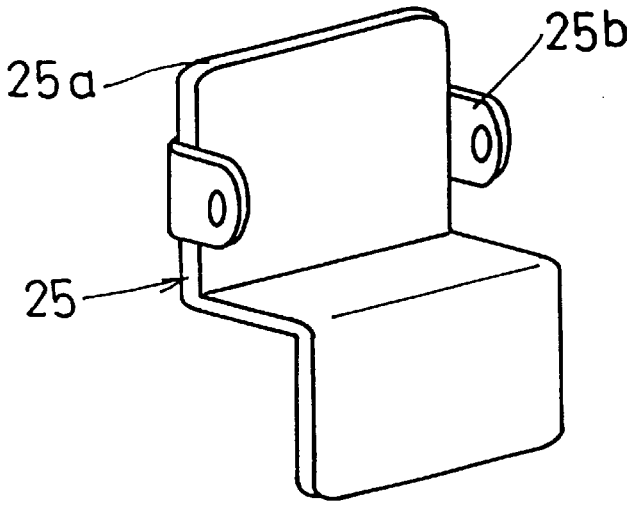
FIG. 8 is a perspective view showing a stopper within the slider shown in FIGS. 1(*a*) and 1(*b*)

Based on FIG. 8, explained in more details, the stopper 25 is formed generally in S-letter shape and extended vertically. And, at its upper portion it is provided with bearing portion 25*b* and pivoted, as shown in FIG. 4, at the joining portion at which the slide block 13 and slide plate 20 are contacted, so that the top end 25*a* of the stopper 25 is positioned at the position adjacent to the engaging position with the projection 22*b* formed on the side surface of the holder 22.

Accordingly, at the time of paper-cutting, the stopper 25 is postured substantially in the vertical direction and is out of contact with the projection 22*b* formed on the side surface of the holder 22. Then, if the top cover 21 is pressed, the rotary blade 10 is projected downwardly from the paper holding plate 3.

Figures 1A, 1B:
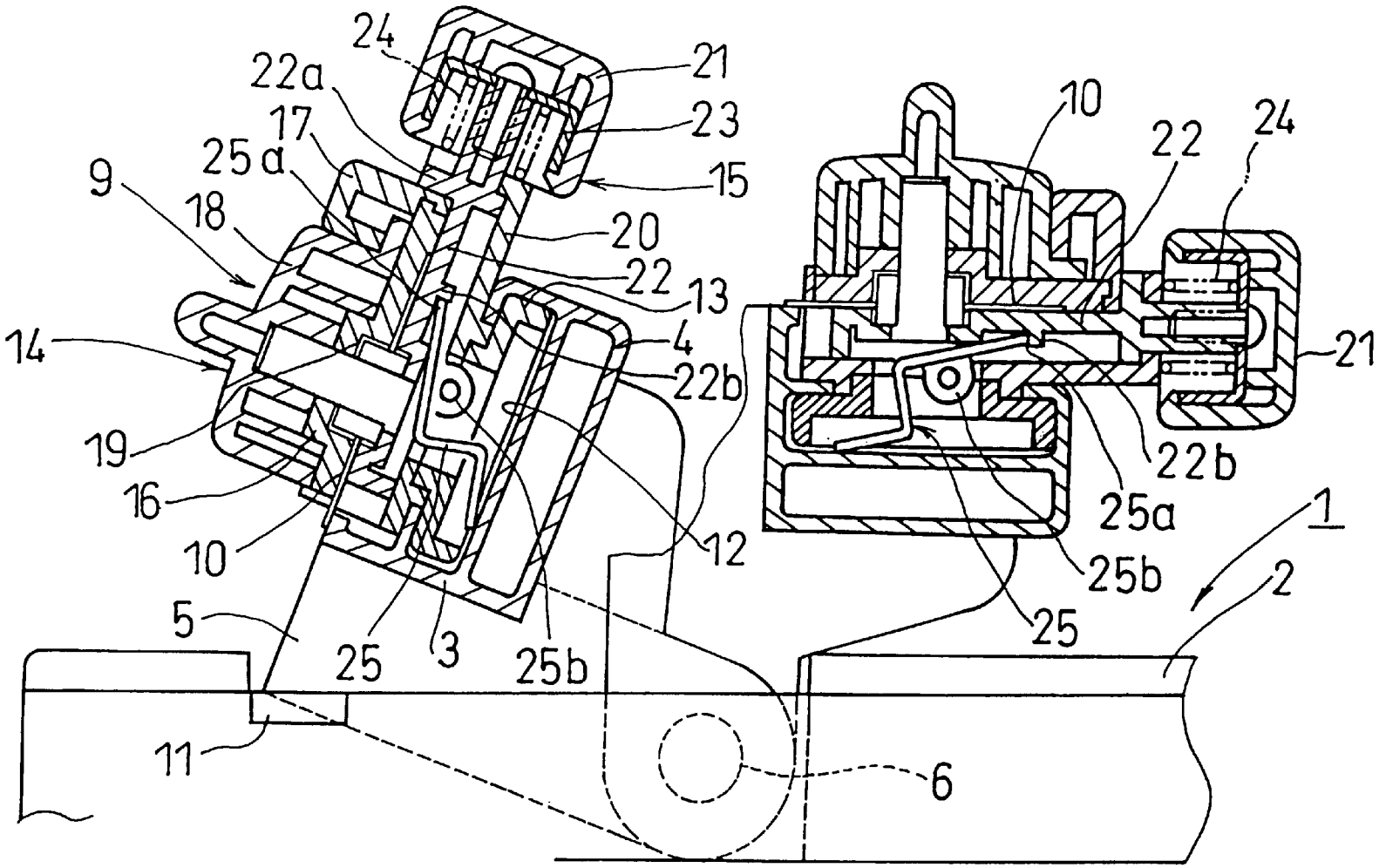
FIGS. 1(*a*) and 1(*b*) are side cross-sectional views showing the slider in two slanted conditions in accordance with an embodiment of the present invention.
Figure 9A:
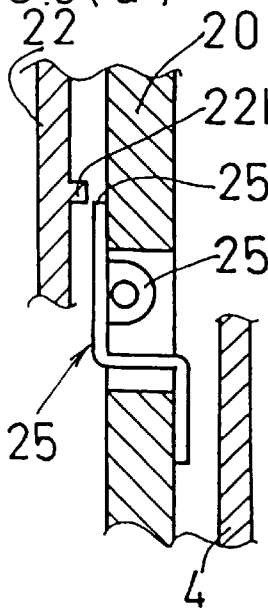
FIGS. 9(*a*) to 9(*c*) are side elevational views showing the operation of the stopper shown in FIG. 8 into parts (a), (b) and (c)
Figure 9B:
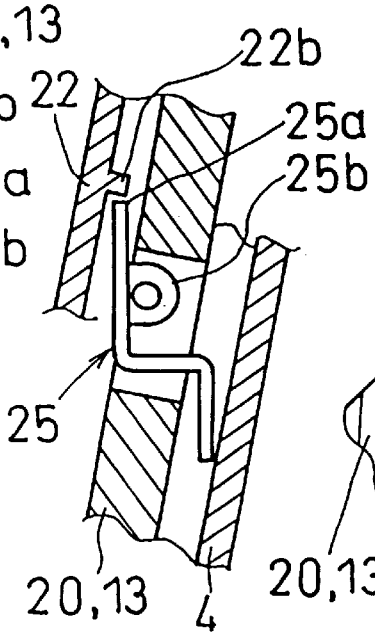
Figure 9C:
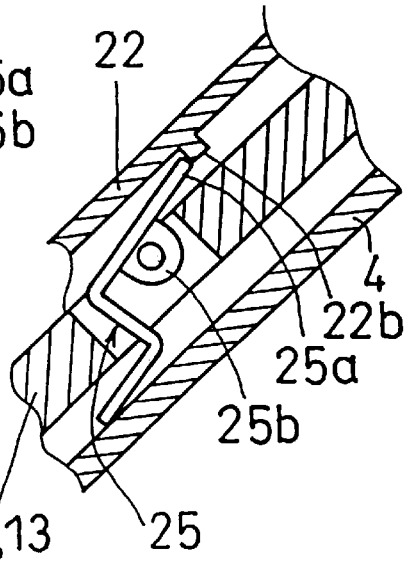

A state where the guide rail 4 and the slider 9 are rotated to stop the cutting operation will now be described with reference with FIGS. 1 and 9.

Under the state where the guide rail 4 is slanted, the other components are also kept in a slanted condition. However, the stopper 25 in the vicinity of the holder 22 is effected by the moment of rotation in the anti-clockwise direction caused by its unbalanced weight. Accordingly, the top end 25*a* of the stopper 25 can be positioned in contact with the projection 22*b* formed on the side surface of the holder 22. Namely, even in the slanted condition as shown in FIG. 1(*a*), the stopper 25 can be brought into engagement with the projection 22*b*, and also in the 90° slanted condition as shown in FIG. 1(*b*), the engagement may be kept. In any position of these positions, even if the top cover 21 is pressed, it does not move and the rotary blade 10 is kept retracted. In the normal condition shown in FIG. 9(*a*), the projection 22*b* of the holder 22 is close to the top end 25a of the stopper 25 but separated away from the top end 25*a*. In the slanted conditions shown in FIGS. 9(*b*) and 9(*c*), the stopper 25 is slanted in engagement with the projection 22*b* of the holder 22. Whenever the guide rail 4 is somewhat slanted, the rotary blade 10 is prevented from being projected. Accordingly, it becomes safer to move the paper cutter 1 or to carry it, then, an easy handling of the cutter may be realized.

Figure 10:
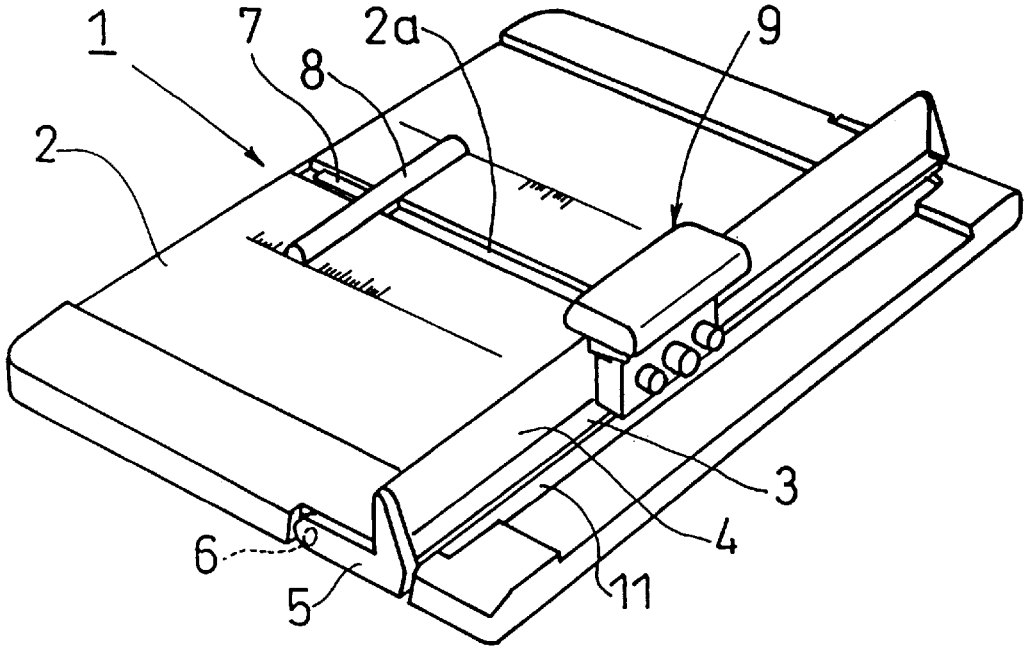
FIG .10 Prior Art
FIG. 10 is a perspective view showing a conventional paper cutter.
Figure 11:
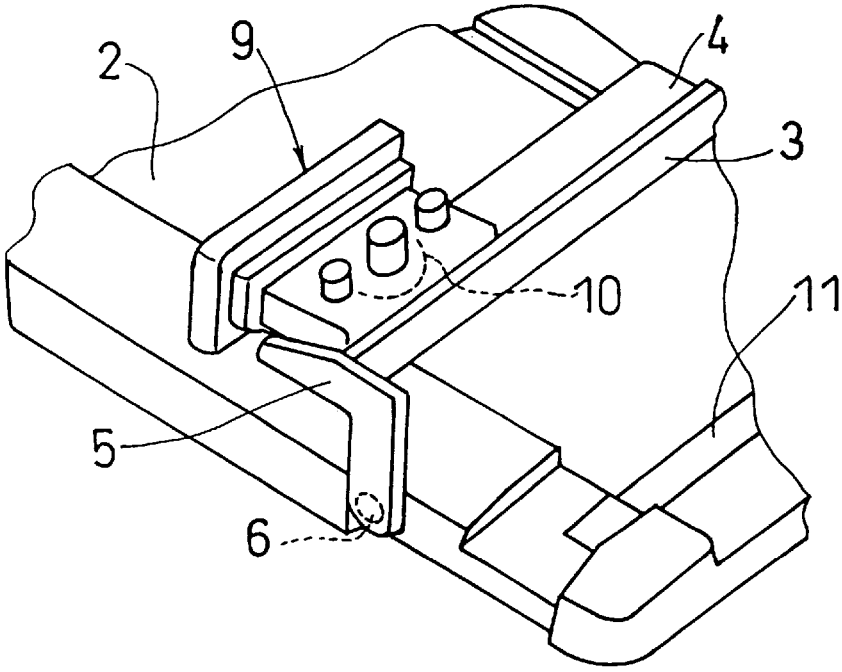
FIG .11 Prior Art
FIG. 11 is a perspective view showing a main part of paper cutter shown in FIG. 10, in which the guide rail of the paper cutter is slanted.

Although the present invention has been explained illustrating the type in which, as shown in FIG. 10, the guide rail 4 is rotated on the paper stand 2 in parallel with the paper stand 2, now another type in which the guide rail 4 is pivoted on one end thereof at the end of the paper stand 2 and the other end thereof is swung up and down is explained using this stopper 25 for the safety sake. In this type, when the guide rail 4 is lifted for inserting papers to be cut, and if the top cover 23 is pushed, the rotary blade 10 is exposed under the rail 4. Accordingly, if a safety mechanism, that is, the stopper 25, illustrated in FIG. 9(*a*) is mounted in the slider, when the guide rail 4 is lifted, the state of the stopper 25 will be postured as shown in FIGS. 9(*b*) and 9(*c*), i.e., the rotary blade 10 will be prevented from being exposed under the guide rail 4 as well as in the above mentioned embodiment.

As mentioned above, in the paper cutter in which the guide rail with the slider having the rotary blade is rotated on the paper stand to cut the paper, the stopper is provided in the slider which, when cutting the paper, is postured vertically and when the slider is slanted, it prevents the rotary blade from being exposed.

Accordingly, when handling or carrying the conventional paper cutter, it has been necessary to take care so as not to be injured. However, in the present invention which is made for solving the aforementioned problem, even if the slider is in any posture other than to cut the paper, there is no danger to be hurt by the exposed rotary blade because the rotary blade is automatically prevented from being exposed.

What is claimed is:

1. A paper cutter having:

a paper stand;

a pair of arms attached to the paper stand defining a contacting position and a separating position;

a guide rail connected to the pair of arms such that the guide rail is parallel to the paper stand;

a slider slidably attached to the guide rail;

the slider comprising:

a rotary blade fixed on a holder, the blade being capable of being moved up and down within the slider against a spring, the blade exposed by being pushed down;

a projection attached to the slider;

a stopper, with a top end and a heavy end, which rotates automatically on a shaft due to the heavy end, hooking the top end on the projection to prevent the rotary blade from being projected from the slider when the guide rail is rotated to other than the contacting position.

2. A paper cutter according to claim 1, wherein the stopper avoids hooking on the projection when the guide rail is in the contact position, allowing the blade to be exposed.

* * * * *